US011595763B2

(12) United States Patent
Fung et al.

(10) Patent No.: US 11,595,763 B2
(45) **Date of Patent: *Feb. 28, 2023**

(54) SENSORY-BASED ENVIRONMENTAL ADAPTATION

(71) Applicant: Cochlear Limited, Macquarie University (AU)

(72) Inventors: Stephen Fung, Dundas Valley (AU); Alexander von Brasch, Cremorne (AU)

(73) Assignee: Cochlear Limited, Macquarie University (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/317,050

(22) Filed: May 11, 2021

(65) Prior Publication Data

US 2021/0337320 A1 Oct. 28, 2021

Related U.S. Application Data

(63) Continuation of application No. 16/400,120, filed on May 1, 2019, now Pat. No. 11,032,653.

(60) Provisional application No. 62/667,655, filed on May 7, 2018.

(51) Int. Cl.
*H04R 25/00* (2006.01)

(52) U.S. Cl.
CPC ..... *H04R 25/305* (2013.01); *H04R 25/505* (2013.01); *H04R 25/554* (2013.01); *H04R 25/558* (2013.01); *H04R 2225/39* (2013.01); *H04R 2225/55* (2013.01)

(58) Field of Classification Search
CPC ..... H04R 25/55; H04R 2225/39; H04R 2225/41; H04R 2225/55; H04R 2460/07
See application file for complete search history.

(56) References Cited

U.S. PATENT DOCUMENTS

| | | | | |
|---|---|---|---|---|
| 6,498,955 | B1 | 12/2002 | McCarthy et al. | |
| 7,751,578 | B2 * | 7/2010 | Arz | H04R 25/558 381/312 |
| 8,295,504 | B2 * | 10/2012 | Ady | G11B 33/144 381/73.1 |
| 8,862,273 | B2 * | 10/2014 | Karr | G05D 19/02 381/71.1 |
| 9,712,928 | B2 * | 7/2017 | Pedersen | H04R 25/552 |
| 9,716,939 | B2 * | 7/2017 | Di Censo | H04R 1/1083 |
| 9,769,577 | B2 * | 9/2017 | Shennib | H04R 25/558 |
| 10,123,133 | B2 * | 11/2018 | Pontoppidan | H04R 25/30 |
| 10,510,345 | B2 * | 12/2019 | Bhat | H04R 25/558 |
| 2014/0153757 | A1 | 6/2014 | Ku et al. | |

(Continued)

OTHER PUBLICATIONS

Oticon OPN, Sample Oticon IFTTT Solution Guides, https://web.archive.org/web/20170831100636/https://www.oticon.com/support/how-to/ifttt/guides, Originally accessed on Aug. 31, 2017.

*Primary Examiner* — Ryan Robinson
(74) *Attorney, Agent, or Firm* — Edell, Shapiro & Finnan, LLC

(57) ABSTRACT

Presented herein are techniques for monitoring the sensory outcome of a recipient of a sensory prosthesis in an ambient environment that includes one or more controllable network connected devices. The sensory outcome of the recipient in the environment is used to make operational changes to the one or more controllable network connected devices in order to create an improved environment for recipient.

20 Claims, 9 Drawing Sheets

(56) References Cited

U.S. PATENT DOCUMENTS

| | | | | |
|---|---|---|---|---|
| 2014/0341408 | A1 | 11/2014 | Varghese et al. | |
| 2015/0294085 | A1 | 10/2015 | Kare et al. | |
| 2016/0203700 | A1* | 7/2016 | Bruhn | H04R 1/1041 340/506 |
| 2017/0289704 | A1 | 10/2017 | Frederiksen et al. | |
| 2018/0046156 | A1* | 2/2018 | Gary, Jr. | H04L 12/2816 |
| 2018/0331845 | A1* | 11/2018 | Warren | H04L 67/22 |
| 2019/0368103 | A1* | 12/2019 | Choung | D06F 37/203 |
| 2020/0084061 | A1* | 3/2020 | Lawrenson | H04L 12/2827 |
| 2020/0099545 | A1* | 3/2020 | Hong | H04R 25/558 |

* cited by examiner

SENSORY-BASED ENVIRONMENTAL ADAPTATION

CROSS-REFERENCE TO RELATED APPLICATIONS

This is a continuation of U.S. patent application Ser. No. 16/400,120, filed May 1, 2019, which claims the benefit of U.S. Provisional Patent Application No. 62/667,655, filed on May 7, 2018, the contents of which is hereby incorporated by reference herein.

BACKGROUND

Field of the Invention

The present invention relates generally to the dynamic adaption of the ambient environment of a sensory prosthesis.

Related Art

Hearing loss is a type of sensory impairment that is generally of two types, namely conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals who suffer from conductive hearing loss typically have some form of residual hearing because the hair cells in the cochlea are undamaged. As such, individuals suffering from conductive hearing loss typically receive an auditory prosthesis that generates motion of the cochlea fluid. Such auditory prostheses include, for example, acoustic hearing aids, bone conduction devices, and direct acoustic stimulators.

In many people who are profoundly deaf, however, the reason for their deafness is sensorineural hearing loss. Those suffering from some forms of sensorineural hearing loss are unable to derive suitable benefit from auditory prostheses that generate mechanical motion of the cochlea fluid. Such individuals can benefit from implantable auditory prostheses that stimulate nerve cells of the recipient's auditory system in other ways (e.g., electrical, optical and the like). Cochlear implants are often proposed when the sensorineural hearing loss is due to the absence or destruction of the cochlea hair cells, which transduce acoustic signals into nerve impulses. An auditory brainstem stimulator is another type of stimulating auditory prosthesis that might also be proposed when a recipient experiences sensorineural hearing loss due to damage to the auditory nerve.

For other types of sensory impairment, other types of sensory prostheses are available. For instance, in relation to vision loss, a sensory prosthesis can take the form of a retinal prosthesis.

SUMMARY

In one aspect, a method is provided. The method comprises: monitoring a hearing outcome of a recipient of an auditory prosthesis in an ambient acoustic environment, wherein the ambient acoustic environment has at least one controllable network connected device associated therewith; analyzing the recipient's hearing outcome in the ambient acoustic environment to determine one or more operational changes to the at least one controllable network connected device that are estimated to improve the recipient's hearing outcome in the ambient acoustic environment; and initiating the one or more operational changes to the at least one controllable network connected device.

In another aspect, a method is provided. The method comprises: obtaining hearing outcome data representing a hearing outcome of a recipient of an auditory prosthesis within an ambient acoustic environment, wherein the ambient acoustic environment includes at least one controllable network connected device; obtaining controllable device operation data representing operations of the at least one controllable network connected device; based on the hearing outcome data and the controllable device operation data, determining one or more operational changes to the at least one controllable network connected device; and initiating the one or more operational changes to the controllable network connected device.

In another aspect an apparatus is provided. The apparatus comprises: a wireless transceiver; and one or more processors coupled to the wireless transceiver and configured to: analyze a hearing outcome of a recipient of an auditory prosthesis in an ambient acoustic environment that has at least one controllable network connected device associated therewith, and based on the analysis of the hearing outcome, initiate one or more changes to the at least one controllable network connected device to dynamically adapt the acoustics of the ambient acoustic environment. [ono] In another aspect, a method is provided. The method comprises: at a sensory prosthesis located in a spatial region, converting sensory inputs into stimulation signals for delivery to a recipient of the sensory prosthesis, wherein the spatial region has at least one controllable network connected device associated therewith; determining, based on the conversion of the sensory inputs into stimulation signals, a sensory outcome of the recipient of the sensory prosthesis within the spatial region; determining one or more operational changes to the at least one controllable network connected device that are estimated to improve the sensory outcome of the recipient within the spatial region; and initiating the one or more operational changes to the at least one controllable network connected device.

BRIEF DESCRIPTION OF THE DRAWINGS

Embodiments of the present invention are described herein in conjunction with the accompanying drawings, in which.

DETAILED DESCRIPTION

Figure 1A:
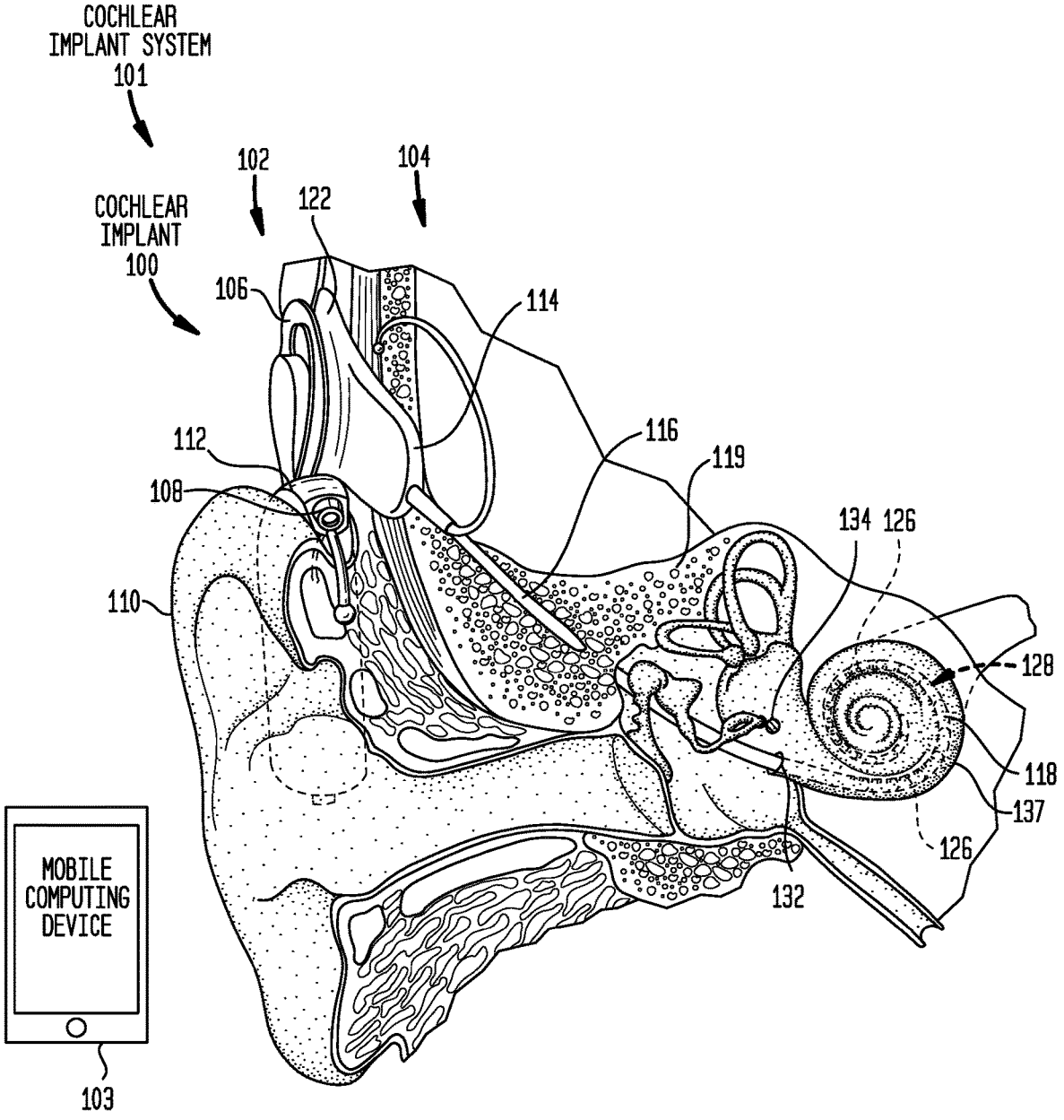
FIG. 1A is a schematic diagram illustrating a cochlear implant system comprising a cochlear implant and mobile computing device, in accordance with certain embodiments presented herein.

Sensory prostheses are devices that, in general, enhance or restore operation of one or more of a recipient's senses (i.e., a recipient's physiological capacity for perception). Two example types of sensory prostheses are auditory prostheses and visual prostheses.

In practice, recipients of sensory prostheses can be exposed to different ambient environments (e.g., different ambient acoustic environments, different ambient lighting environments, etc.) that each have different characteristics/attributes. Since each ambient environment is unique, and since each sensory prosthesis recipient has unique sensory function, the effectiveness of different sensory prostheses may vary from environment to environment and from recipient to recipient. As a result, conventional sensory prostheses often attempt to adjust their associated (i.e., their own) operating settings to account for the environmental variations.

With the growth of the Internet of Things (IoT), the ambient environments encountered by sensory prosthesis recipients will increasingly include so-called "smart" objects, sometimes referred to as IoT enabled-devices, IoT devices, or controllable network connected devices. These controllable network connected devices are physical "objects" or "things" that generally serve some purpose or function outside of computing and/or networking technologies (i.e., traditionally "unconnected" or "offline" devices), but to which networking and control capabilities have been added. Controllable network connected devices can take a number of different forms and can include, for example, thermometers, air conditioning units, refrigerators, microwaves, lights or lighting fixtures, windows, walls, etc. Presented herein are techniques that leverage the increasing use of controllable network connected devices to enhance the experience of sensory prosthesis recipients. In particular, in accordance with the techniques presented herein, through communication between a sensory prosthesis system and controllable network connected devices in the ambient environment, the controllable network connected devices (i.e., the "things") present in the ambient environment are controlled, managed, reconfigured, or otherwise adapted to create an improved/better (e.g., optimized) sensory outcome for the recipient in the ambient environment. That is, the controllable network connected devices can be adapted in such a way to improve (e.g., optimize) the ambient environment for the sensory prosthesis recipient.

As described further below, the techniques presented herein are based on spatial and environmental awareness of the ambient environment of a recipient of a sensory prosthesis. As such, the adaptions to the environment (i.e., to the operation of the network connected devices that form the ambient environment) are specific to not only the characteristics of the environment, but also the recipient's specific needs as well the recipient's specific location in the environment. That is, the environmental adaptions could be different for each recipient and for each location in the environment (even with the same recipient). As such, the techniques presented herein can optimize the environment for the specific recipient (i.e., the specific needs of the recipient) based, at least on part, on the specific and environmental awareness of the ambient environment.

Merely for ease of description, the techniques presented herein are primarily described herein with reference to one illustrative sensory prosthesis, namely a cochlear implant. However, it is to be appreciated that the techniques presented herein may also be used with a variety of other sensory prosthesis or medical devices that, while providing a wide range of therapeutic benefits to recipients, patients, or other users, may benefit from the techniques presented. For example, the techniques presented herein may be used with other hearing prostheses, including acoustic hearing aids, bone conduction devices, middle ear auditory prostheses, direct acoustic stimulators, other electrically simulating auditory prostheses (e.g., auditory brain stimulators), etc. The techniques presented herein may also be used with other sensory prostheses, such as visual prostheses (e.g., retinal prostheses), etc.

Figure 1B:
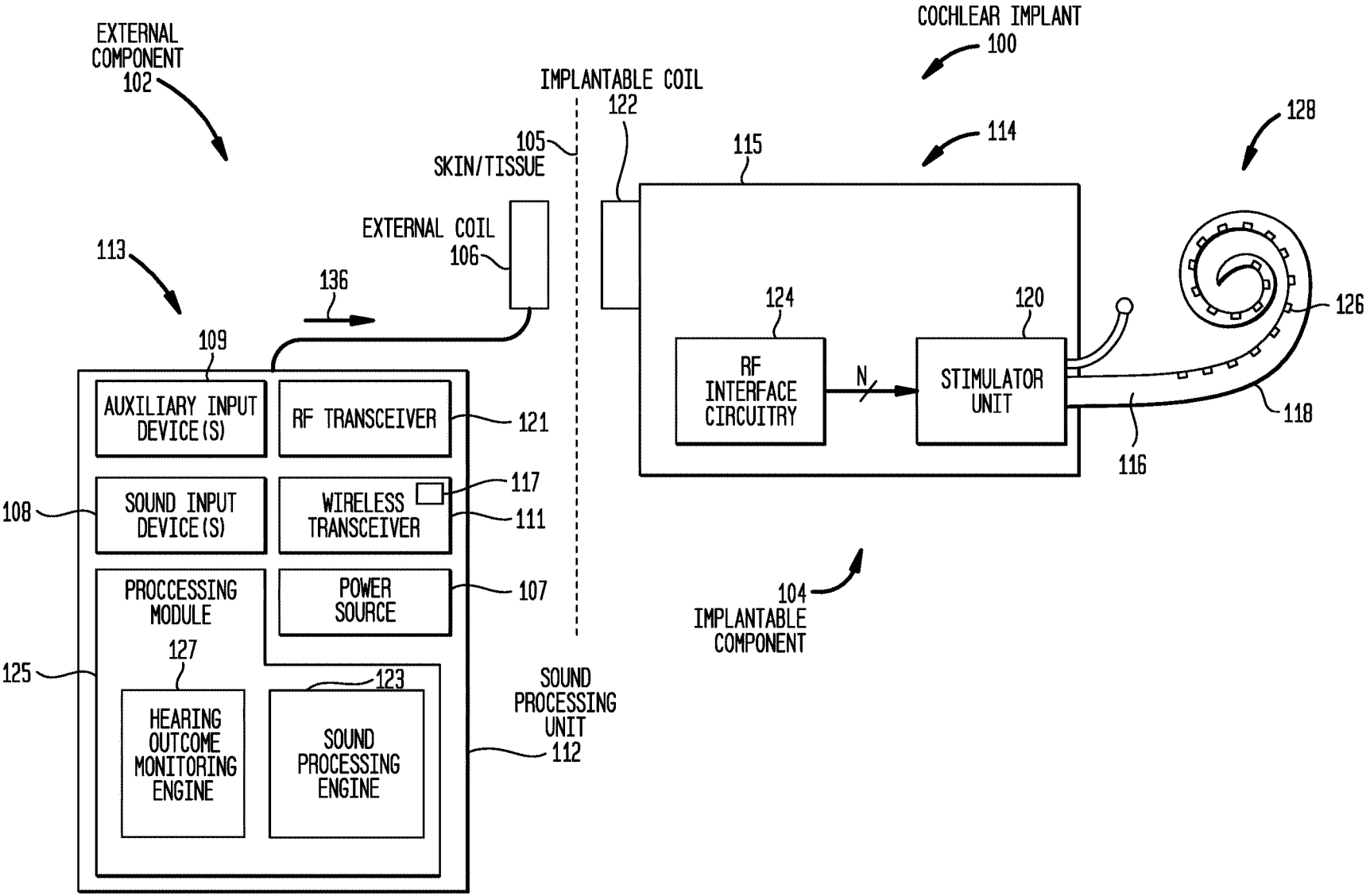
FIG. 1B is a block diagram of the cochlear implant of FIG. 1A.
Figure 1C:
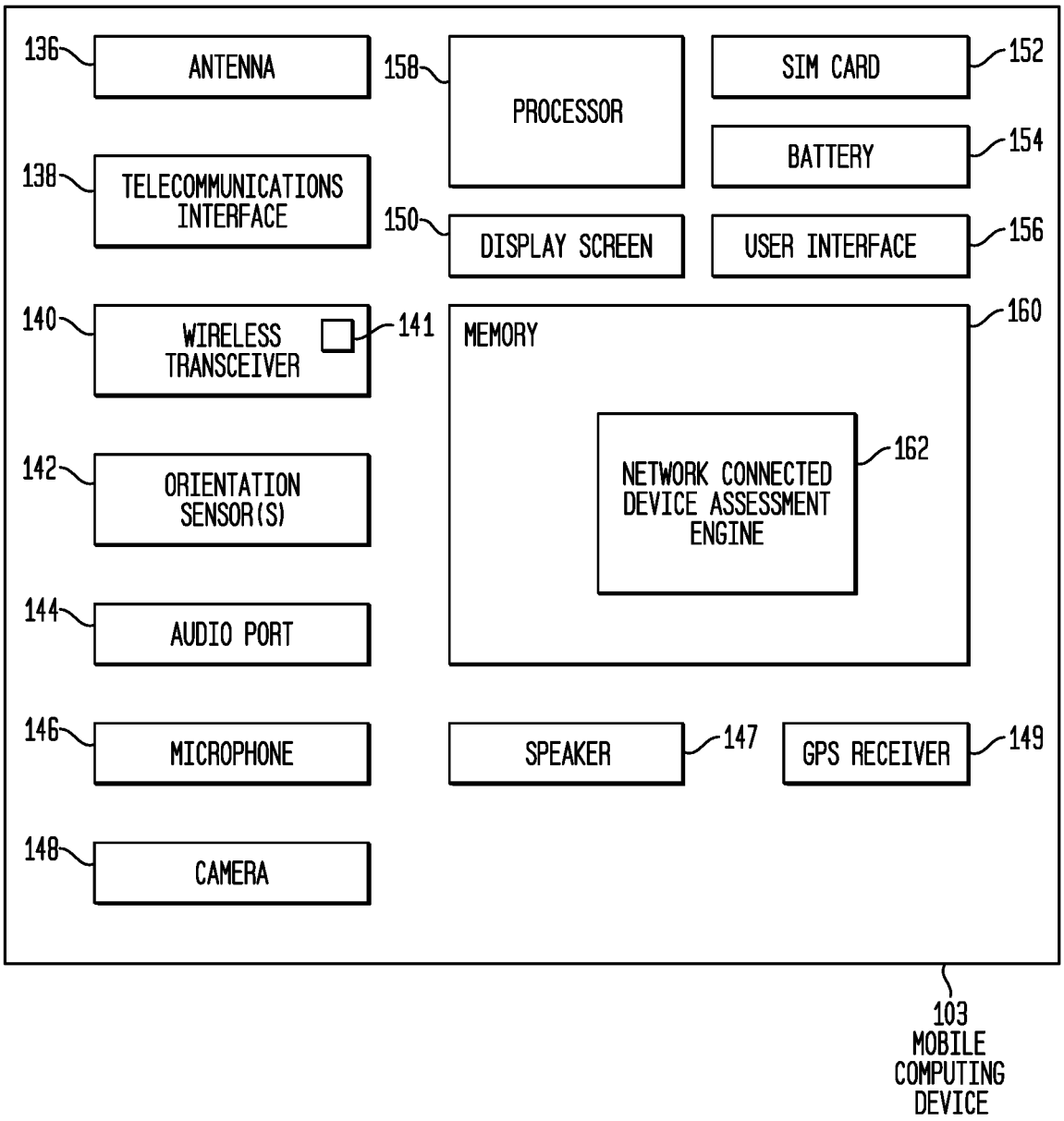
FIG. 1C is a block diagram of the mobile computing device of FIG. 1A.

Shown in FIGS. 1A, 1B, and 1C is an exemplary cochlear implant system 101 configured to execute the techniques presented herein. More particularly, FIG. 1A is a schematic diagram of the exemplary cochlear implant system 101, which comprises a cochlear implant 100 and a mobile computing device 103. FIG. 1B is a block diagram illustrating one example arrangement of the cochlear implant 100, while FIG. 1C is a block diagram illustrating one example arrangement of the mobile computing device 103. For ease of illustration, FIGS. 1A and 1B will be described together, followed by a description of FIG. 1C.

The cochlear implant 100 comprises an external component 102 and an internal/implantable component 104. The external component 102 is configured to be directly or indirectly attached to the body of the recipient and typically comprises an external coil 106 and, generally, a magnet (not shown in FIG. 1A) fixed relative to the external coil 106. The external component 102 also comprises one or more input elements/devices 113 for receiving input signals at a sound processing unit 112. In this example, the one or more one or more input devices 113 include sound input devices 108 (e.g., microphones positioned by auricle 110 of the recipient, telecoils, etc.) configured to capture/receive input signals, one or more auxiliary input devices 109 (e.g., audio ports, such as a Direct Audio Input (DAI), data ports, such as a Universal Serial Bus (USB) port, cable port, etc.), and a wireless transmitter/receiver (transceiver) 111, each located in, on, or near the sound processing unit 112.

The wireless transceiver 111 may have a number of different arrangements. In one example, the wireless transceiver 111 includes an integrated antenna 117 and may be configured to operate in accordance with the Bluetooth® or other short-range wireless technology standard that enables the sound processing unit 112 to wirelessly communicate with another device (i.e., receive and transmit data to/from another device via a wireless connection using, for example, 2.4 Gigahertz (GHz) Ultra high frequency (UHF) radio waves, 5 GHz Super high frequency (SHF) radio waves, etc.). Bluetooth® is a trademark of Bluetooth Special Interest Group (SIG), Inc. It is to be appreciated that reference to the Bluetooth® standard is merely illustrative and that the wireless transceiver 111 may make use of any other wireless standard now known or later developed.

The sound processing unit 112 also includes, for example, at least one power source (e.g., battery) 107, a radio-frequency (RF) transceiver 121, and a processing module 125 that includes a sound processing engine 123 and a hearing outcome monitoring engine 127. The processing module 125, and thus the sound processing engine 123 and the hearing outcome monitoring engine 127, may be formed by any of, or a combination of, one or more processors (e.g., one or more Digital Signal Processors (DSPs), one or more uC cores, etc.), firmware, software, etc. arranged to perform operations described herein. That is, the processing module 125 may be implemented as firmware elements, partially or fully implemented with digital logic gates in one or more application-specific integrated circuits (ASICs), partially or fully in software, etc.

In the examples of FIGS. 1A and 1B, the external component 102 comprises a behind-the-ear (BTE) sound processing unit 112 configured to be attached to, and worn adjacent to, the recipient's ear and a separate coil 106. However, it is to be appreciated that embodiments of the present invention may be implemented with systems that include other arrangements, such as systems comprising a button sound processing unit (i.e., a component having a generally cylindrical shape and which is configured to be magnetically coupled to the recipient's head and which includes an integrated coil), a mini or micro-BTE unit, an in-the-canal unit that is configured to be located in the recipient's ear canal, a body-worn sound processing unit, etc.

Returning to the example embodiment of FIGS. 1A and 1B, the implantable component 104 comprises an implant body (main module) 114, a lead region 116, and an intra-cochlear stimulating assembly 118, all configured to be implanted under the skin/tissue (tissue) 105 of the recipient. The implant body 114 generally comprises a hermetically-sealed housing 115 in which RF interface circuitry 124 and a stimulator unit 120 are disposed. The implant body 114 also includes an internal/implantable coil 122 that is generally external to the housing 115, but which is connected to the RF interface circuitry 124 via a hermetic feedthrough (not shown in FIG. 1B).

Stimulating assembly 118 is configured to be at least partially implanted in the recipient's cochlea 137. Stimulating assembly 118 includes a plurality of longitudinally spaced intra-cochlear electrical stimulating contacts (electrodes) 126 that collectively form a contact or electrode array 128 for delivery of electrical stimulation (current) to the recipient's cochlea. Stimulating assembly 118 extends through an opening in the recipient's cochlea (e.g., cochleostomy, the round window, etc.) and has a proximal end connected to stimulator unit 120 via lead region 116 and a hermetic feedthrough (not shown in FIG. 1B). Lead region 116 includes a plurality of conductors (wires) that electrically couple the electrodes 126 to the stimulator unit 120.

As noted, the cochlear implant 100 includes the external coil 106 and the implantable coil 122. The coils 106 and 122 are typically wire antenna coils each comprised of multiple turns of electrically insulated single-strand or multi-strand platinum or gold wire. Generally, a magnet is fixed relative to each of the external coil 106 and the implantable coil 122. The magnets fixed relative to the external coil 106 and the implantable coil 122 facilitate the operational alignment of the external coil with the implantable coil. This operational alignment of the coils 106 and 122 enables the external component 102 to transmit data, as well as possibly power, to the implantable component 104 via a closely-coupled wireless link formed between the external coil 106 with the implantable coil 122. In certain examples, the closely-coupled wireless link is a radio frequency (RF) link. However, various other types of energy transfer, such as infrared (IR), electromagnetic, capacitive and inductive transfer, may be used to transfer the power and/or data from an external component to an implantable component and, as such, FIG. 1B illustrates only one example arrangement.

The processing module 125 of sound processing unit 112 is configured to perform a number of operations. In particular, the processing module 125 is configured to convert sound/audio signals into stimulation control signals 136 for use in stimulating a first ear of a recipient (i.e., the sound processing engine 123 is configured to perform sound processing on input audio signals received at the sound processing unit 112). The sound signals that are processed and converted into stimulation control signals may be sound signals received via the sound input devices 108, signals received via the auxiliary input devices 109, and/or signals received via the wireless transceiver 111.

In the embodiment of FIG. 1B, the stimulation control signals 136 are provided to the RF transceiver 121, which transcutaneously transfers the stimulation control signals 136 (e.g., in an encoded manner) to the implantable component 104 via external coil 106 and implantable coil 122. That is, the stimulation control signals 136 are received at the RF interface circuitry 124 via implantable coil 122 and provided to the stimulator unit 120. The stimulator unit 120 is configured to utilize the stimulation control signals 136 to generate electrical stimulation signals (e.g., current signals) for delivery to the recipient's cochlea via one or more stimulating contacts 126. In this way, cochlear implant 100 electrically stimulates the recipient's auditory nerve cells, bypassing absent or defective hair cells that normally transduce acoustic vibrations into neural activity, in a manner that causes the recipient to perceive one or more components of the input audio signals.

The processing module 125 also includes the hearing outcome monitoring engine 127. As described further below, the hearing outcome monitoring engine 127 is configured to obtain measurements or other data that enables the evaluation of a "hearing outcome" or "hearing performance" of a recipient of the cochlear implant 100 in the present/current ambient acoustic environment. In other words, the hearing outcome monitoring engine 127 is a system that tracks/monitors one or different types of data (e.g., sound data, perceptual responses of the recipient, etc.) for use in analyzing/assessing, in real-time, the hearing outcome of the recipient in the present ambient acoustic environment. Data representing the hearing outcome of the recipient, sometimes referred to herein as hearing outcome data, may be analyzed at the processing module 125 or transmitted/emitted as part of wireless signals sent via, for example, the wireless transceiver 111 to another device, such as the mobile computing device 103. As noted, further details regarding the operation of the hearing outcome monitoring engine 127 are provided below.

As noted, FIGS. 1A, and 1B illustrate one example arrangement for the cochlear implant 100. However, it is to be appreciated that embodiments of the present invention may be implemented in cochlear implants, hearing prostheses, or other sensory prostheses having alternative arrangements. For example, it is to be appreciated that the use of an external component is merely illustrative and that the techniques presented herein may be used in arrangements having an implanted sound processor (e.g., totally implantable cochlear implants, etc.). It is also to be appreciated that the individual components referenced herein, e.g., sound input element 108 and the sound processor in sound processing unit 112, may be distributed across more than one prosthesis, e.g., two cochlear implants, and indeed across more than one type of device, e.g., cochlear implant 100 and a consumer electronic device or a remote control of the cochlear implant 100.

Also as noted above, cochlear implant system 101 includes a mobile computing device 103. The mobile computing device 103 is a portable electronic component capable of storing and processing electronic data and configured to communicate with the cochlear implant 100. Mobile computing device 103 may comprise, for example, a mobile or satellite "smart" phone, collectively and generally referred to herein simply as "mobile phones," a tablet computer, a personal digital assistant (PDA), a remote control device, or another portable personal device enabled with processing and communication capabilities.

FIG. 1C is a block diagram of an illustrative arrangement for mobile computing device 103 as a mobile phone. It is to be appreciated that FIG. 1C is merely illustrative of one arrangement for a mobile computing device configured to execute techniques for described herein.

Mobile computing device 103 comprises an antenna 136 and a telecommunications interface 138 that are configured for communication on a wireless communication network for telephony services (e.g., a Global System for Mobile Communications (GSM) network, code division multiple access (CDMA) network, time division multiple access (TDMA), or other kinds of networks). As shown in FIG. 1C, mobile computing device 103 also includes a wireless transceiver 140 that may have a number of different arrangements. In one example, the wireless transceiver 140 includes an integrated antenna 141 and may be configured to operate in accordance with the Bluetooth® or other short-range wireless technology standard that enables the mobile computing device 103 to wirelessly communicate with another device (i.e., receive and transmit data to/from another device via a wireless connection using, for example, 2.4 Gigahertz (GHz) Ultra high frequency (UHF) radio waves, 5 GHz Super high frequency (SHF) radio waves, etc.). It is to be appreciated that reference to the Bluetooth® standard is merely illustrative and that the wireless transceiver 140 may make use of any other wireless standard now known or later developed.

Mobile computing device 103 also comprises one or more orientation sensors 142 (e.g., one or more of an accelerometer, a gyroscope, a magnetometer, etc.), an audio port 144, one or more sound input elements, such as a microphone 146, a speaker 147, a camera 148, a display screen 150, a subscriber identity module or subscriber identification module (SIM) card 152, a battery 154, a user interface 156, a satellite positioning system receiver/chip 149 (e.g., GPS receiver), a processor 158, and a memory 160 that comprises network connected device assessment engine 162.

The display screen 150 is an output device, such as a liquid crystal display (LCD), for presentation of visual information to the user. The user interface 156 may take many different forms and may include, for example, a keypad, keyboard, mouse, touchscreen, display screen, etc. In one specific example, the display screen 150 and user interface 156 are combined to form a touch screen. More specifically, touch sensors or touch panels have become a popular type of user interface and are used in many types of devices. Touch panels recognize a touch input of a user and obtain the location of the touch to effect a selected operation. A touch panel may be positioned in front of a display screen, or may be integrated with a display screen. Such configurations, allow the user to intuitively connect a pressure point of the touch panel with a corresponding point on the display screen, thereby creating an active connection with the screen. In certain embodiments, display screen 150 is used to provide information to locate external component 102, as described further below.

Memory 160 may comprise read only memory (ROM), random access memory (RAM), magnetic disk storage media devices, optical storage media devices, flash memory devices, electrical, optical, or other physical/tangible memory storage devices. The processor 158 is, for example, a microprocessor or microcontroller that executes instructions for the network connected device assessment engine 162. Thus, in general, the memory 160 may comprise one or more tangible (non-transitory) computer readable storage media (e.g., a memory device) encoded with software comprising computer executable instructions and when the software is executed (by the processor 158) it is operable to perform all or part of the techniques presented herein. That is, the network connected device assessment engine 162, when executed by processor 158 is a program/application configured to perform or enable one or more of operations described herein to locate another device, such as external component 102 of cochlear implant 100.

As noted above, the mobile computing device 103 may receive the hearing outcome data from the cochlear implant 100. The network connected device assessment engine 162 is a system that is generally configured to use the hearing outcome data to manage the status of the recipient's hearing outcome and, in turn, coordinate with controllable network connected devices in the environment to make operational changes thereto (e.g., initiate changes to the operating status/mode, etc. of the controllable network connected devices) in order to create an improved listening environment for recipient. That is, the network connected device assessment engine 162 may be configured to analyze the ambient acoustic environment of the cochlear implant 100, using the hearing outcome data and known capabilities of the controllable network connected devices present in the ambient acoustic environment, to determine and subsequently initiate operational changes to one or more of the controllable network connected devices present in the ambient acoustic. The operational changes to the controllable network connected devices are selected to dynamically adapt the ambient acoustic environment in a manner that, for example, improves the recipient's hearing outcome in the ambient acoustic environment. In certain embodiments, operation of the network connected device assessment engine 162 may be based on feedback and machine learning techniques. Further details regarding the operation of the network connected device assessment engine 162 are provided below.

FIG. 1C illustrates a software implementation for network connected device assessment engine 162. It is to be appreciated that this software implementation of FIG. 1C is merely illustrative and that the network connected device assessment engine 162 may be formed by any of, or a combination of, one or more processors (e.g., one or more DSPs, one or more uC cores, etc.), firmware, software, etc. arranged to perform operations described herein. That is, the network connected device assessment engine 162 may be implemented as firmware elements, partially or fully implemented with digital logic gates in one or more ASICs, partially or fully in software, etc.

FIGS. 1B and 1C illustrate an example arrangement in which the hearing outcome monitoring engine 127 is implemented on the sound processing unit 112 of cochlear implant 100 and the network connected device assessment engine 162 is implemented on the mobile computing device 103. It is to be appreciated that this specific arrangement of hearing outcome monitoring engine 127 and network connected device assessment engine 162 is illustrative and that other arrangements are possible. For example, in other embodiments the network connected device assessment engine 162 could alternatively be implemented on the sound processing unit 112 or another device disposed in a local or remote location. That is, the use of the mobile computing device 103 as the central processing unit/entity is illustrative and that the techniques presented herein may be partially or fully implemented by logic residing in sound processing unit 112, a cloud-based computing device (e.g., server), etc. In certain examples, the mobile computing device 103 may be omitted and the techniques could be fully implemented by the sound processing unit 112 or by the sound processing unit 112 and a cloud-based computing device.

As noted above, in the example of FIGS. 1A-1C, the cochlear implant 100 is a type of auditory prosthesis that enhances or restores the recipient's ability to hear sounds. In practice, the recipient (and thus the cochlear implant 100) can be exposed to a number of different ambient acoustic/sound environments, which can range from quiet environments to noisy environments and which may include speech, music, and/or other sounds. Since each ambient acoustic environment is unique, and since each cochlear implant or auditory prosthesis recipient has unique hearing characteristics, the effectiveness of different auditory prostheses may vary from environment to environment. As a result, conventional auditory prostheses often attempt to adjust their own sound processing settings to account for the environmental variations. In general, these conventional adjustments relate to the processing of the incoming audio signals on the auditory prosthesis, with the assumption being that a better hearing outcome could be achieved by improved handling and controlling settings and audio processing on the prosthesis. For example, a number of auditory prostheses "classify" the acoustic environment as one of a number of broad types/categories (e.g., "quiet," "speech-in-quiet," "speech-in-noise," "music," etc.) and apply sound processing settings that are pre-selected for use in that determined acoustic environment type.

As noted above, the growth of IoT has resulted in the increasing presence of controllable network connected devices in the ambient acoustic environments encountered by auditory prosthesis recipients. Presented herein are techniques that leverage the increasing use of controllable network connected devices to enhance the listening experience of auditory prosthesis recipient. In particular, in accordance with the techniques presented herein, through communication between the auditory prosthesis system and controllable network connected devices in the ambient environment, the controllable network connected devices (i.e., the "things") which are present in the locale and which affect the acoustics in the ambient environment (i.e., the auditory environment) are controlled, managed, reconfigured, or otherwise adapted to help to contribute to an improved/better hearing outcome for the recipient. That is, the controllable network connected devices can be adapted in such a way to improve (e.g., optimize) the auditory environment for the recipient.

Figure 2:
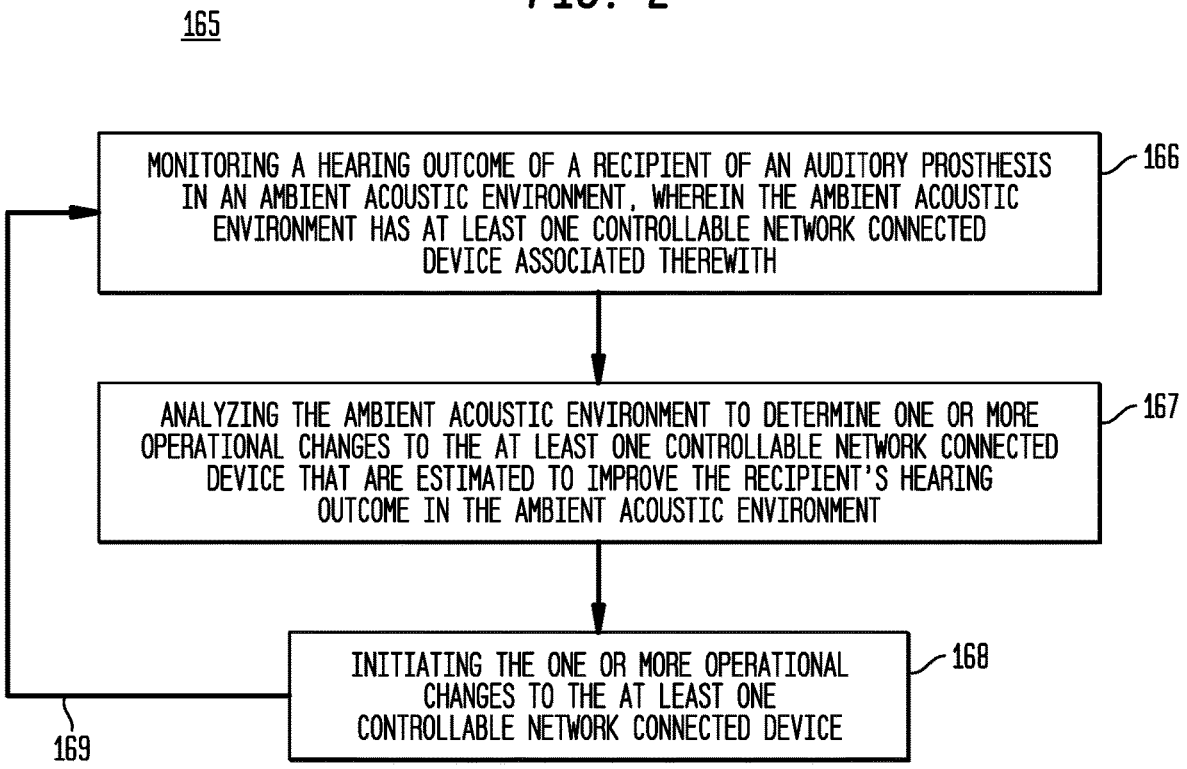
FIG. 2 is a flowchart of a sensory-based environmental adaption method, in accordance with certain embodiments presented herein.

FIG. 2 is a flowchart illustrating an environmental adaption method 165 in accordance with embodiments presented herein. Method 165 begins at 166 where a hearing outcome of a recipient of an auditory prosthesis (e.g., cochlear implant 100, acoustic hearing aid, bone conduction device, etc.) in an ambient acoustic environment is monitored. The auditory prosthesis (e.g., cochlear implant, acoustic hearing aid, bone conduction device, etc.), generates stimulation signals for delivery to a recipient of an auditory prosthesis. The stimulation signals are configured to induce (e.g., evoke, enhance, etc.) perception of sound signals captured from an ambient acoustic environment having at least one controllable network connected device associated therewith (e.g., positioned therein). The stimulation signals may comprise, for example, electrical stimulation (current) signals, acoustic stimulation signals, mechanical stimulation signals, etc. The ambient acoustic environment has at least one controllable network connected device associated therewith.

As used herein, a "hearing outcome" or "hearing performance" of the recipient is an estimate or measure of how effectively stimulation signals delivered to the recipient represent sound signals captured from the ambient acoustic environment. As described further below, the hearing outcome of the recipient may be monitored or analyzed for example, based on an auditory perception of the recipient following delivery of the stimulation signals to the recipient, based on a listening effort (cognitive load) of the recipient upon delivery of the stimulation signals to the recipient, based on one or more attributes of the sound signals prior to delivery of the stimulation signals to the recipient, etc.

Returning to method 165 of FIG. 2, at 167 the recipient's hearing outcome ambient acoustic environment is analyzed to determine one or more operational changes to the at least one controllable network connected device that are estimated to improve the recipient's hearing outcome in the ambient acoustic environment. For example, in certain arrangements, the ambient acoustic environment is analyzed using the hearing outcome of the recipient and real-time operations of the at least one controllable network connected device. This analysis, in concert with known operational capabilities of the at least one controllable network connected device, is used to identify the one or more operational changes to the at least one controllable network connected device.

At 168, the one or more changes to the operation of the controllable network connected device may be initiated. In certain embodiments, as shown by arrow 169, the operations of 166, 167, and 168 may be repeated one or more times to periodically, continuously, etc., refine or adapt the operation of the controllable network connected devices in a manner that improves the recipient's hearing outcome.

Further understanding of the techniques presented herein may be appreciated through description of several example use cases, which are described with reference to FIGS. 3A, 3B, and 4. For ease of illustration, the examples of FIGS. 3A, 3B, and 4 will be described with reference to cochlear implant system 101 of FIGS. 1A-1C. However, as noted above, it is to be appreciated that the techniques presented herein may be implemented with a number of other types of sensory prostheses and sensory prosthesis systems.

Figure 3A:
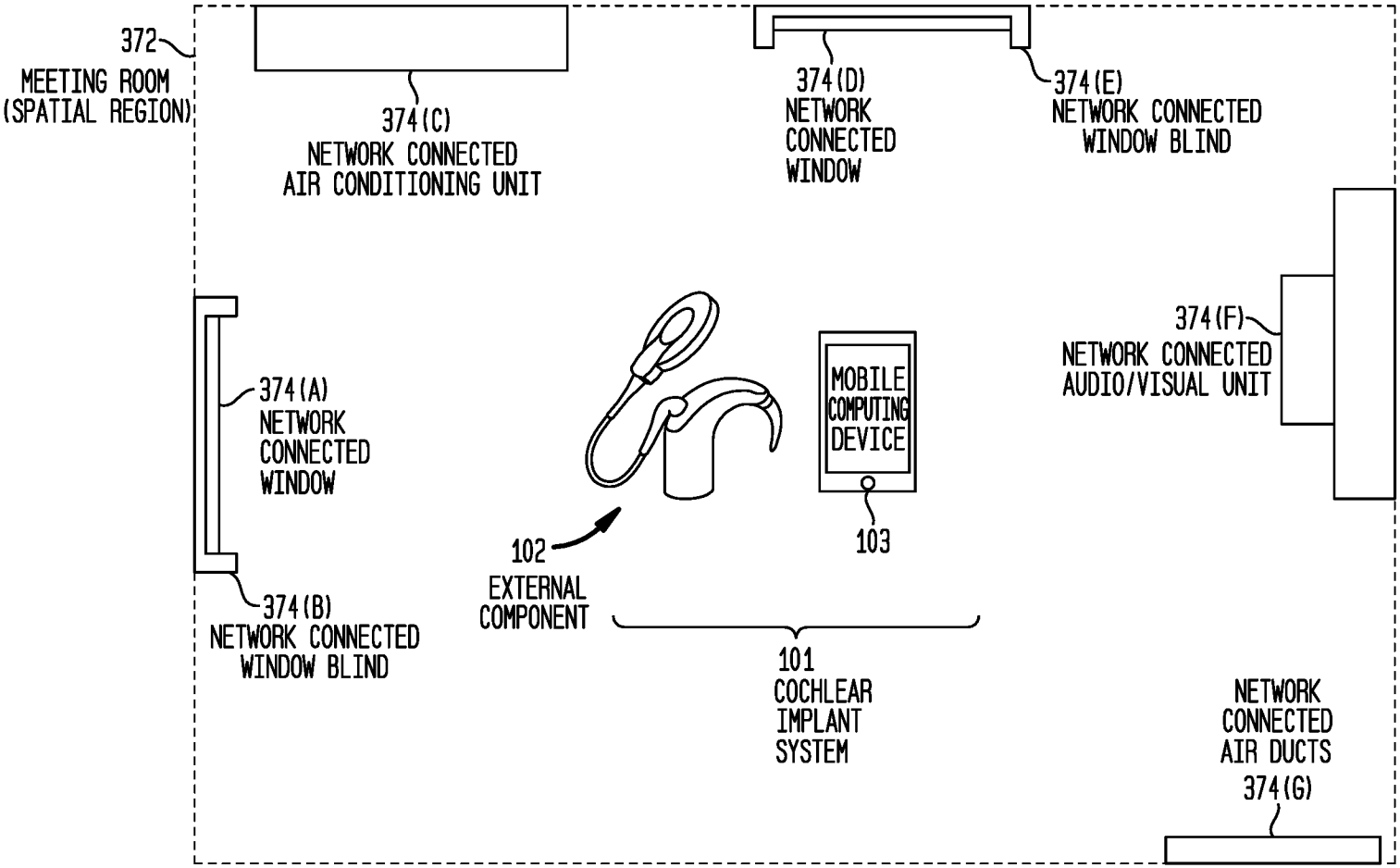
FIG. 3A is a schematic diagram illustrating a cochlear implant system in an example spatial region, in accordance with certain embodiments presented herein.
Figure 3B:
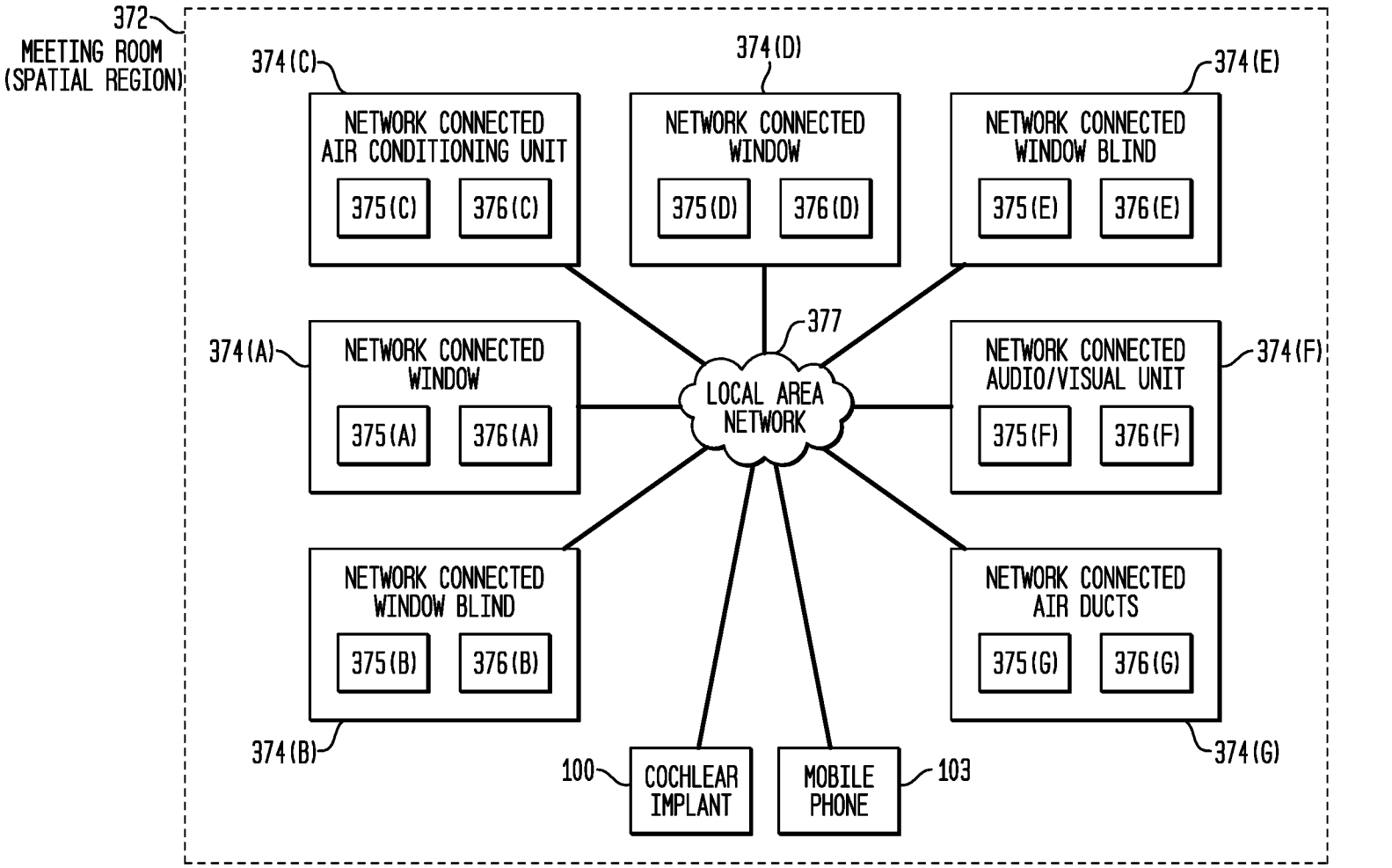
FIG. 3B is a block diagram illustrating a network arrangement for the cochlear implant system and spatial region of FIG. 3A, in accordance with certain embodiments presented herein.

Referring first to FIGS. 3A and 3B, shown in FIG. 3A is a schematic diagram illustrating a spatial region 372 in which a recipient of cochlear implant 100 is positioned/located. FIG. 3B is a block diagram illustrating a networking arrangement for the spatial region 372. For ease of illustration, the recipient and implantable component 104 have been omitted from FIGS. 3A-3B and, as such, only the external component 102 of cochlear implant 100 is shown.

The spatial region 372 generally represents the boundaries of an "ambient acoustic environment" of the cochlear implant system 101. The ambient acoustic environment includes, or is formed by, persons or articles (e.g., physical objects, structural building components, electrical or mechanical devices, etc.) that affect the acoustics with the spatial region. In practice, the ambient acoustic environment is dynamic and may change, for example, as different people speak, sound sources are turned on/off, etc.

In the example of FIGS. 3A and 3B, the spatial region 372 is a meeting or conference room that includes a plurality of controllable network connected devices (e.g., IoT devices) associated therewith (e.g., positioned therein). More specifically, the controllable network connected devices associated with spatial region 372 include a first network connected window 374(A), a first network connected window blind 374(B), a network connected air conditioning unit 374(C), a second network connected window 374(D), a second network connected window blind 374(E), a network connected audio/visual unit 374(F), and a network connected air duct 374(G), collectively and generally referred to as controllable network connected devices 374. As such, the ambient acoustic environment shown in FIG. 3A includes the controllable network connected devices 374, as well as the walls of meeting room 372, any persons in the meeting room, and possibly other articles, all of which have been omitted from FIG. 3A, for ease of illustration.

In general, the controllable network connected devices 374 may all operate in a "default" or "normal" mode of operation in which the devices perform their primary association function (e.g., cooling the meeting room 372, displaying audio or visual information, etc.) possibly independent from one another (e.g., in an uncoordinated manner). As shown in FIG. 3B, the controllable network connected devices 374 each include, among other elements, a control module, referred to as control modules 375(A)-375(G), respectively, and a wireless transceiver, referred to as wireless transceivers 376(A)-376(G), respectively. The control modules 375(A)-375(G) are sometimes collectively and generally referred to as control modules 375, while the wireless transceivers 376(A)-376(G) are sometimes collectively and generally referred to as wireless transceivers 376.

In this example, the control modules 375(A)-375(G), are configured to dictate or set the operation of the associated controllable network connected devices 374(A)-374(G). For example, the control modules 375(A)-375(G) can cause the associated device to operate differently (e.g., in a different mode, in accordance with different settings, etc.). As described further below, the control modules 375(A)-375(G) may set the operation of the associated controllable network connected devices 374(A)-374(G) based on instructions received from the mobile computing device 103.

The wireless transceivers 376 enable the controllable network connected devices 374 to wirelessly communicate with, for example, each other or other local or devices over a wireless local area network (LAN) 377. The wireless local area network 377 may include one or more networking devices (e.g., a gateway that translates proprietary communication protocols to Internet Protocol) that enable communication or may simply represent the use of a specific network protocol to enable direct communication between the controllable devices 374. As such, the wireless transceivers 376 may be configured to operate in accordance with the Bluetooth® wireless standard, the IEEE 802.15.4 radio standard, the IEEE 802.11 standards (e.g., Wi-Fi), or other wireless standard now known or later developed.

The controllable devices 374 are referred to herein as forming a wireless "local device network" 378 in the meeting room 372. It is to be appreciated that other devices that are not shown in FIGS. 3A and 3B may also form part of the local device network. When the cochlear implant system 101 is positioned in the meeting room, the cochlear implant 100 and/or the mobile computing device 103 may also join the local device network 378. As such, the cochlear implant 100 and/or the mobile computing device 103 may be configured to wireless communicate with the controllable network connected devices 374.

Returning to the specific example of FIGS. 3A and 3B, upon the occurrence of a triggering event, the cochlear implant 100 (e.g., hearing outcome monitoring engine 127) is configured to begin monitoring the hearing outcome of the recipient in the meeting room 372. The triggering event to initiate assessment/monitoring the hearing outcome may comprise, for example, a determination that the cochlear implant 100 is positioned in the meeting room 372 (e.g., the moment the recipient steps into the meeting room), the receipt of a user input (e.g., the recipient providing a touch input or voice input (e.g., voice recognition) at the external component 102, mobile computing device 103, etc.), the detection of a particular noise or sound, real-time characterization/classification of the acoustic environment at the recipient, psycho-acoustic or objective measurements, etc.

In the example of FIGS. 3A and 3B, data representing the hearing outcome of the recipient is provided to the mobile computing device 103. Using this hearing outcome data, the mobile computing device 103 (e.g., the network connected device assessment engine 162) is configured to analyze a hearing outcome of the recipient within the ambient acoustic environment. Analysis of the hearing outcome of the recipient within the ambient acoustic environment within meeting room 372 may include assessment of the auditory perception of the recipient of sound signals captured within the ambient acoustic environment, assessment of the listening effort of the recipient when perceiving stimulation signals, analyzing one or more attributes of sound signals captured from the ambient acoustic environment, etc. In certain examples, the analysis of the hearing outcome of the recipient within the ambient acoustic environment within meeting room 372 results in a determination of the effect(s) of the controllable network connected devices 374, if any, on the hearing outcome of the recipient.

As noted, the mobile computing device 103 is part of the wireless local device network 378 and, as such, is in communication with the controllable network connected devices 374. As part of this communication, the mobile computing device 103 (e.g., the network connected device assessment engine 162) is made aware of the operational capabilities of the controllable network connected devices 374, as well as the real-time operations of the controllable network connected devices 374. The operational capabilities and the real-time operations of the controllable network connected devices 374, sometimes collectively referred to herein as the "controllable device operation data" can be used by the mobile computing device 103 in the analysis of the hearing outcome of the recipient.

In addition, the controllable device operation data can also be used to determine one or more changes to the operation of one or more of the controllable network connected devices 374, where the changes are expected/estimated to improve the hearing outcome of the recipient within the ambient acoustic environment. Stated differently, the mobile computing device 103 (e.g., the network connected device assessment engine 162) is configured to analyze the hearing outcome of the recipient, in view of the controllable device operation data, to determine if there are operational changes that could be made to any of the controllable network connected devices 374 that would improve the recipient's hearing outcome. The mobile computing device 103 may then initiate the selected change(s). For example, the mobile computing device 103 could send notifications instructing the control module(s) 375 of the selected controllable network connected device(s) 374 to adjust the operations of the associated device in a specified manner.

In one specific example, the mobile computing device 103 analyzes the hearing outcome of the recipient of cochlear implant 100 in the ambient acoustic environment and determines that the recipient is showing difficulty in the hearing environment. In addition, the mobile computing device 103 determines that noise from the network connected audio/visual unit 374(F) is negatively effecting the recipient's hearing outcome (e.g. there noise coming from the fan of the overhead projector). As noted above, the mobile computing device 103 is aware of the operational capabilities of the controllable network connected devices 374. As such, the mobile computing device 103 can analyze the hearing outcome of the recipient and the capabilities of the network connected audio/visual unit 374(F) to determine if there operational changes that could be made to the network connected audio/visual unit 374(F) that would improve the recipient's hearing outcomes. The mobile computing device 103 may then initiate the change(s) (e.g., by sending a notification to control module 375(F) instructing the control module to adjust operation of the overhead projector such that the fan will create less noise (e.g., slow down the speed of the fan; use a filter that would temporary block the sound from reaching the recipient's direction; switch to a different operating mode; redirect the fan noise in a different direction, etc.)).

In operation, the audio/visual unit 374(F) may adapt itself based on the instructions from the mobile computing device 103. In the meantime, the system continues to monitor the recipient's hearing outcome (i.e., continues to capture hearing outcome data and analyze the data based on the controllable device operation data). As such, the above operations may be repeated, as needed, to periodically, continually, etc. improve the recipient's hearing outcome.

In the above example, the network connected audio/visual unit 374(F) is determined to be negatively effecting the recipient's hearing outcome and changes are made to the network connected audio/visual unit 374(F) itself in an effort to improve the recipient's hearing outcome. However, it is to be appreciated that in other embodiments changes may also or alternatively be made to different controllable network connected devices, regardless of whether those devices are negatively effecting the recipient's hearing outcome. For example, continuing within the above example, in addition to, or instead of, changing the operation of the network connected audio/visual unit 374(F), the ventilation in the room could be improved by automatically adjusting the network connected additional air ducts 374(G), the physical arrangement (e.g., angle) of the network connected window blinds 374(B) and 374(E) could be adjusted to reduce reverberation in the meeting room 372, etc. That is, the mobile computing device 103 (e.g., the network connected device assessment engine 162) may be configured to analyze the hearing outcome based on a global view of the entire ambient acoustic environment and, accordingly, determine and make any of a number of changes to the controllable network connected devices 374, as needed, to improve recipient's hearing outcome (i.e., to adapt the ambient acoustic environment to the needs of the recipient). It is also to be appreciated that the techniques presented herein are used not only with devices that generate acoustic noise, but instead can adapt any device having effect on the acoustics in the meeting room 372.

Continuing with the above example, mobile computing device 103 may also determine that noise from the network connected air conditioning unit 374(C) is present in the meeting room 372. The mobile computing device 103 is able to analyze the hearing outcome of the recipient and the capabilities of network connected air conditioning unit 374(C) to determine if this noise is effecting the recipient's hearing outcome and, accordingly, if operational changes could be made that would improve the recipient's hearing outcomes. In this example, given the position of the recipient within the meeting room 372, the orientation of the recipient, and the beam-former directionality of the microphones of the cochlear implant 100, the mobile computing device 103 determines that the network connected air conditioning unit 374(C) is in within a directional null of the beam-former. As such, the mobile computing device 103 determines that the network connected air conditioning unit 374(C) has limited impact on the hearing perception of the recipient.

Further, as noted, the meeting room 372 includes network connected audio/visual unit 374(F) that includes multiple different speakers for delivery of audio output. The mobile computing device 103 may be configured to analyze the current speakers used by the network connected audio/visual unit 374(F) and, if appropriate, adapt which speakers are used for the audio output. For example, the mobile computing device 103 may be aware of the position, orientation, or other spatial information about the cochlear implant 100. Given this recipient-specific spatial information, spatial information regarding the other objects in the room (such as the network connected air conditioning unit 374(C), network connected windows 374(A) and 374(D), network connected window blinds 374(B) and 374(E), network connected audio/visual unit 374(F), etc.), and the hearing outcome of the recipient, the mobile computing device 103 can evaluate the current speakers used to deliver the audio output and instruct the network connected audio/visual unit 374(F) to make changes thereto as to give the recipient the best chance of perceiving the audio call. In a similar way, the mobile computing device 103 could also instruct the network connected audio/visual unit 374(F) to change the microphone used to pick up the speech from the recipient, from its set of available microphones, to achieve the best audio quality.

As described above with reference to FIGS. 3A and 3B, the mobile computing device 103 (e.g., the network connected device assessment engine 162) is configured to adapt the controllable network connected devices 374 within the meeting room 372. In certain embodiments, the mobile computing device 103 may also be configured to not only adapt an ambient acoustic environment to the recipient, but also to adapt the operation of the cochlear implant 100. An example of this might be while riding in a car, where there is a background noise from the engine that is dominant at one specific frequency, and it may not be trivial to alter the operating mode of the engine to remove this from the hearing range of the user. However, many auditory prostheses employ notch filters, and in this situation, the car could indicate to the mobile computing device 103 (e.g., the network connected device assessment engine 162) that the engine will run with this specific frequency hum. As such, the mobile computing device 103 could instruct the cochlear implant 100 to adapt an employed notch filter, or employ another notch filter, to suppress the specific frequency hum identified by the car. Therefore, in such an example, the operations of the cochlear implant 100 are adapted based on information received from a controllable network connected device (e.g., the car).

The current state of technology is that an auditory prosthesis alone needs to analyze the incoming sound, and adapt its signal processing to improve the hearing outcome. However, with the growth in IoT, and device-to-device communication, there is now the ability for systems to communicate directly to the hearing prosthesis their noise and audio profile, reducing the load and complexity on the auditory prosthesis, and helping it achieve the optimal setting. Further, the environment now has the ability to adapt as well, giving another dimension to the system, achieving a better optimum than what the device could achieve alone.

Moreover, depending on the design of the external prosthesis (behind-the-ear/off-the-ear sound processors or the hearing aid), most have one or more light emitting diodes (LEDs) or to provide visual feedback to a user. In general, the manner in which the LED(s)s flash indicates the normal operating condition and/or special user setting of the auditory prosthesis. Normally, people (e.g. at the back or by the side) nearby the recipient are hardly aware of the periodic LED flash because there is lot of light in the surrounding environment. However, such LED flash would become obvious when there is less brightness in the environment.

For instance, when the recipient walks into a theatre, according to the existing environment, the system would indicate the auditory prosthesis to start preparing to enter a special mode (e.g. theatre mode). At the moment when the lights in the room gradually go down, the sensor or a wearable device (e.g., watch, smart phone, etc.) would alert the auditory prosthesis to temporarily shut down the LED or to reduce its brightness so as to reduce the distraction causing to the people sitting behind the back of or next to the recipient. Essentially, the LED brightness could adapt based on the ambient light level, where the auditory prosthesis itself need not have the ability to measure the light intensity. Instead, objects better placed and suited can do perform this analysis and communicate the information to the auditory prosthesis directly or via an intermediate device (e.g., watch, smart phone, etc.).

Figure 4:
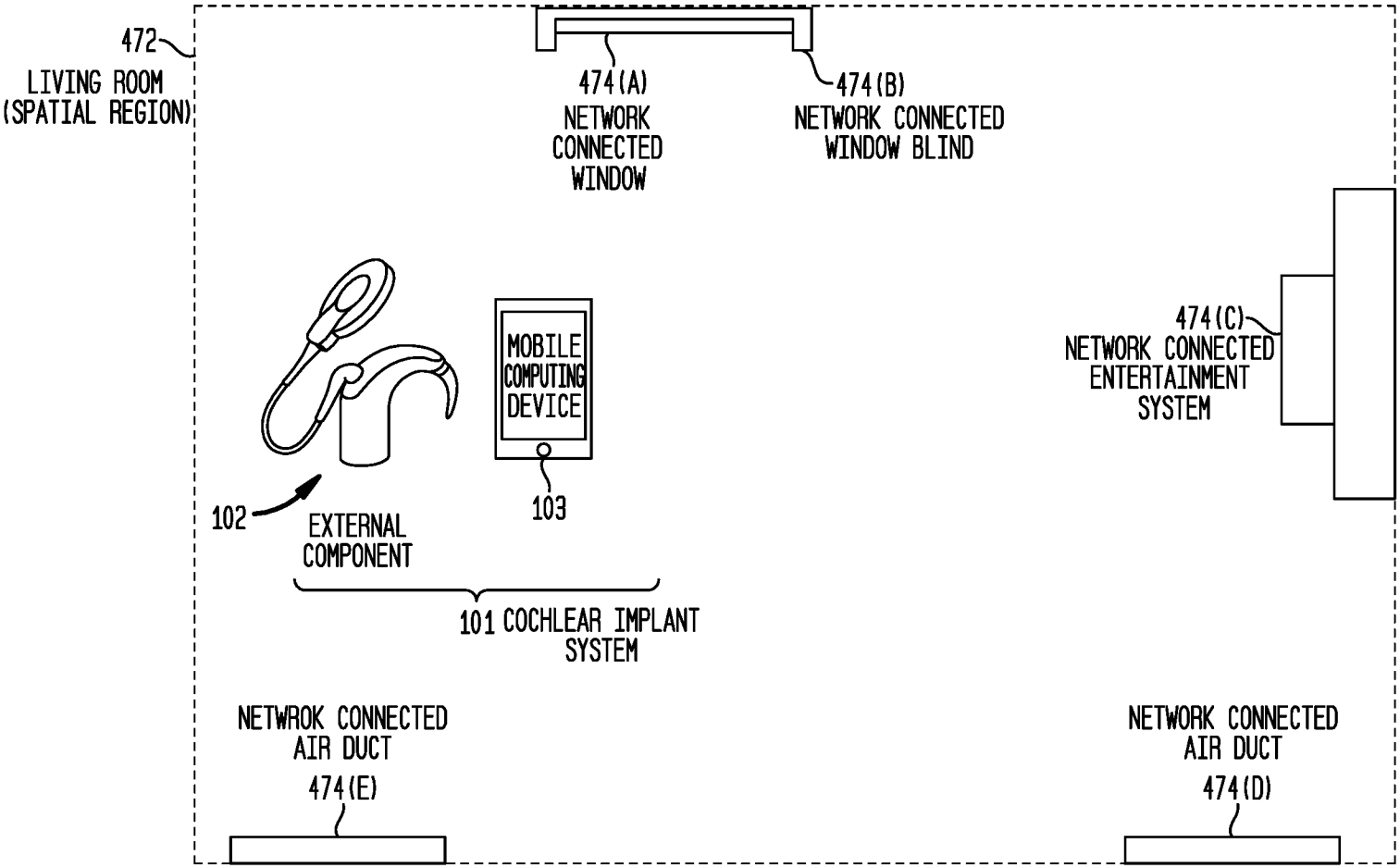
FIG. 4 is a schematic diagram illustrating a cochlear implant system in another example spatial region, in accordance with certain embodiments presented herein.

FIG. 4 illustrates another example arrangement in which the techniques presented herein may be implemented. More specifically, FIG. 4 is a schematic diagram illustrating a spatial region 472 in which a recipient of cochlear implant 100 is positioned/located. For ease of illustration, the recipient and implantable component 104 have been omitted from FIG. 4 and, as such, only the external component 102 of cochlear implant 100 is shown.

Similar to the above example, the spatial region 472 generally represents the boundaries of an ambient acoustic environment of the cochlear implant system 101. In the example of FIG. 4, the spatial region 472 is a living room of a home that includes a plurality of controllable network connected devices (IoT devices) associated therewith (e.g., positioned therein). More specifically, the controllable network connected devices associated with spatial region 472 include a network connected window 474(A), a network connected window blind 474(B), a network connected entertainment system 474(C), and network connected air ducts 474(D) and 474(E), collectively and generally referred to as controllable network connected devices 474. As such, the ambient acoustic environment shown in FIG. 4 includes the controllable network connected devices 474, as well as the walls of the living room 472, any persons in the meeting room, and possibly other articles, all of which have been omitted from FIG. 4, for ease of illustration.

In general, the controllable network connected devices 374 may all operate in a "default" or "normal" mode of operation in which the devices perform their primary association function. However, similar to the embodiment of FIGS. 3A and 3B, the controllable network connected devices 474 each include, among other elements, a control module and a wireless transceiver that enable the controllable network connected devices 474 to wirelessly communicate with, for example, each other or other local or devices over a wireless local area network (LAN). For ease of illustration, the control modules and wireless transceivers have been omitted from FIG. 4. However, similar to the above embodiments, the control modules are configured to dictate or set the operation of the associated controllable network connected devices 474, while the wireless transceivers enable the controllable network connected devices 474 to wirelessly communicate with, for example, each other or other local or devices over a wireless local area network (LAN).

In FIG. 4, the controllable devices 474 are referred to herein as forming a wireless "local device network" in the living room 472. It is to be appreciated that other devices that are not shown in FIG. 4 may also form part of the local device network. In addition, then the cochlear implant system 101 is positioned in the living room 472, the cochlear implant 100 and/or the mobile computing device 103 may also join the local device network. As such, the cochlear implant 100 and/or the mobile computing device 103 may be configured to wirelessly communicate with the controllable network connected devices 474.

In one example in accordance with the arrangement of FIG. 4, the recipient is watching a movie using the network connected entertainment system 474(C), which could be a 5.1 channel surround sound system. Upon the occurrence of a triggering event, the cochlear implant 100 (e.g., hearing outcome monitoring engine 127) is configured to begin monitoring the hearing outcome of the recipient in the living room 472. In the example of FIG. 4, data representing the hearing outcome of the recipient is provided to the mobile computing device 103. Using this data, the mobile computing device 103 (e.g., the network connected device assessment engine 162) is configured to analyze the hearing outcome of the recipient in the ambient acoustic environment of the living room 472 (e.g., based on the controllable device operation data obtained from the controllable network connected devices 474). The mobile computing device 103 may determine, for example, that the recipient is sitting in a location where, due to the particular environmental characteristics of the room, they may be experiencing poor performance with the surround sound system. The mobile computing device 103 (e.g., the network connected device assessment engine 162) is configured to use this analysis, in combination with the controllable device operation data, to determine one or more changes to operation of one or more of the controllable network connected devices 474, where the changes are expected/estimated to improve the hearing outcome of the recipient within the ambient acoustic environment. For example, the mobile computing device 103 could cause the network connected air duct 474(E), which nearest to the recipient, to close and instead increase the output level at network connected air duct 474(D), which is farther away from the recipient. Further, the mobile computing device 103 could cause the network connected entertainment system 474(C) to adjust the balance and output levels of the 5.1 speakers in order to improve the sound quality, from the perspective of the recipient, at the location of the recipient. In addition, the mobile computing device 103 could instruct the cochlear implant 100 to adjust its beam-former and/or signal processing algorithms to best take advantage of this new operating mode of the stereo system.

It is to be appreciated that the techniques presented herein are based on spatial and environmental awareness, where adjustments to the environment are specific to the environment and the recipient's location in the environment. That is, the environmental adaptions could be different for each recipient and for each location. In addition, the environment adaptions are undertaken to improve hearing outcomes.

The examples shown in FIGS. 3A, 3B, and 4 are merely illustrative and are used to generally illustrate use of the techniques presented herein to manage controllable network connected devices (smart things/objects) associated with an acoustic ambient environment to behave differently in a manner that improves the hearing outcome of the recipient. That is, as noted, the controllable network connected devices in the environment are instructed to adapt and coordinate with each other, and operate in a way that would create an optimal hearing experience for the recipient. It is to be appreciated that the techniques presented herein may also or alternatively be used in a number of different arrangements and situations. Provided below are several additional use cases for the techniques presented herein. For ease of illustration, each of these further examples are described with reference to cochlear implant system 101 of FIGS. 1A-1C in which the mobile computing device 103 operates as the central processing unit of the system. However, as described elsewhere herein, the use of the mobile computing device 103 as the central processing unit is illustrative and that the techniques presented herein may be implements by logic residing in a sound processing unit, a cloud-based computing device (e.g., server), etc.

Meeting Room Scenario

The techniques presented herein may be used to optimize a meeting room (or other environment) for a recipient. For example, when a recipient enters a meeting room, operation of a network connected air conditioning system in the room could be automatically be adjusted to minimize noise perceived by the recipient. Additionally or alternatively, a physical location of an object, like a window blind or automatic door, could be adjusted to minimize the impact of reverberation on the recipient's hearing of an externally generated sound, in these parts of the test (where the audio is not streamed, for instance)switched off at key points in the testing, for instance, during measurements of hearing thresholds when the noise level in the room is desired to be as low as possible, and then on again as appropriate, without requiring manual interaction.

Home Testing Scenario

It is now common for cochlear implant recipients to perform some routine testing at home or outside of a clinical setting (e.g., via an application embedded on the mobile computing device 103). In such arrangements, the techniques presented herein may be used to optimize the home environment for the testing. For example, if the mobile computing device 103 is a mobile phone, the mobile computing device 103 may be automatically switched from the 'ringtone' mode into a 'forward message' mode (i.e., the tone/alert would be automatically forwarded and have the recipient's smart phone vibrated instead) in such a way that the ringtone would not cause disruption to the recipient while he/she is taking the hearing test. Alternatively, the mobile phone could be configured to automatically direct calls straight to voicemail for the duration of the hearing test, and notify the recipient of the messages when the testing has finished. In other examples, a network connected air conditioning system in the room could be automatically switched off at key points in the testing, for instance, during measurements of hearing thresholds when the noise level in the room is desired to be as low as possible, and then on again as appropriate, without requiring manual interaction. Moreover, physical location of an object, like a window blind or automatic door, could be adjusted to minimize the impact of reverberation on the recipient's hearing during certain parts of the testing.

In current Remote Care/Home testing systems, the recipient is asked to perform the tests in a quiet environment. In accordance with the techniques presented herein, an environment with controllable network connected devices could automatically become suitably quiet. In another way, the sounds used in the hearing test could in turn be adapted based on the measured sound environment, for instance, if there is a noise within some spectral region(s) outside of control of the system, the test could instead use alternative frequencies, or enable signal processing schemes, which would normally be disabled, to remove this component of the input audio.

Clinical Scenario

The techniques presented herein may also be implemented within a clinical environment. For example, consider a recipient having a history of suffering from tinnitus. At the moment when the recipient enters a clinic, the hearing outcome of the recipient, in terms of tinnitus, could be monitored and analyzed. Based on this analysis, the mobile computing device 103 (or another device present in the clinic) could synchronize any controllable network connected devices in the environment based on the recipient's tinnitus profile. Having known that the recipient is prone to having tinnitus in quiet environments under certain sound levels, the mobile computing device 103 would interact with the loud speakers in the room to start playing low level natural sounds (e.g., ocean wave, rain drop, etc.) or low level music in such a way to create a low-level ambient sound to mask the tinnitus. In this environment, the recipient would then not be aware of the tinnitus, and as a result their attention can be focused on the hearing testing. This helps to prepare the recipient to get to a comfortable state before beginning any clinical testing.

In another example, the techniques presented herein could be leveraged to facilitate the clinical testing. For example, when the recipient walks in to the clinic, a device in the clinic is able to identify the device/recipient, and then automatically load the recipient's required clinical history on to the clinician's computer, tablet, etc., without requiring any manual effort by the clinician or clinical staff.

Seamless Connectivity Experience

Apart from the time spent at home and/or in the office, a person may spend quite some time commuting to and from work using a vehicle. Continuously changing road conditions (e.g., different road surfaces, crossing a metal bridge, etc.), activities happening outside the vehicle (e.g., gusty winds, emergency vehicles, driving in the middle of the heavy rain, etc.), and locations (e.g. driving inside a tunnel or passing a road construction area), create different sounds and can have an effect on the recipient. For example, a recipient is listening to the radio with the car's sunroof open, depending on how fast the car is travelling and the existence of the wind outside, the cochlear implant 100 or mobile computing device 103 would analyze the data and monitor the wind noise effect and compare it against the recipient's hearing perception. When the wind noise effect is becoming too obvious, under this adaptive synchronized system, the wind noise on the sound processor would kick in, at the same time, the mobile computing device 103 would automatically adjust how wide the sunroof should be opened or how high the angle should be raised so as to reduce the noise created by the wind instead of closing the entire sunroof or the car window. At the same time, the volume of the car radio could be automatically adjusted so that the recipient can still listen to what is being broadcasted or activate a third party algorithm on the car radio system to mitigate the wind noise impact. Alternatively, the car radio system could adjust the balance/relative loudness coming from the available speakers. Further, it could also recommend that the hearing prosthesis adjust its beam-former to enhance the best direction, and suppress the source of the wind noise in the modified configuration.

Figure 5:
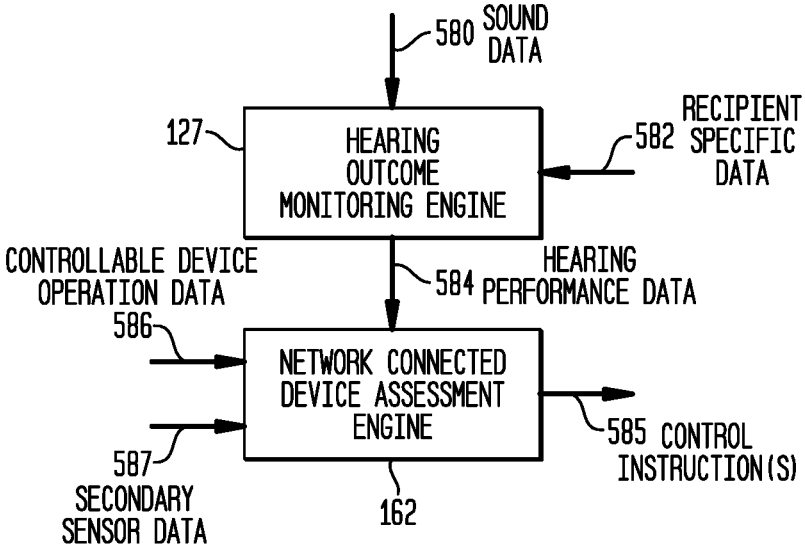
FIG. 5 is a block diagram illustrating functional operations of sensory-based environment adaption techniques, in accordance with certain embodiments presented herein.

Embodiments of the techniques presented herein have been generally described above with reference to specific functional components, namely the hearing outcome monitoring engine 127 and the network connected device assessment engine 162. FIG. 5 is a functional block diagram illustrating further operations of the hearing outcome monitoring engine 127 and the network connected device assessment engine 162. Although the above embodiments have been described with reference to the hearing outcome monitoring engine 127 and the network connected device assessment engine 162 implemented at the cochlear implant 100 and mobile computing device 103, respectively, it is to be appreciated that this specific arrangement of elements is merely illustrative. Instead, different aspects of the present invention can be implemented at different devices and in different combinations. As such, FIG. 5 illustrates the hearing outcome monitoring engine 127 and the network connected device assessment engine 162 separate from any underlying device structure. It is also be appreciated that the functional arrangement of the hearing outcome monitoring engine 127 and the network connected device assessment engine 162 is illustrative and that the operations of the techniques presented may be implemented at a single device or at more than two devices.

Referring specifically to the arrangement of FIG. 5, as noted above the hearing outcome monitoring engine 127 is configured to monitor data relating to the hearing outcome of the recipient within an ambient acoustic environment. This data generally relates to the conversion of sound signals captured from the ambient acoustic environment into stimulation signals for delivery to the recipient and can include sound data 580 and/or recipient-specific data 582. As shown in FIG. 5, the sound data 580 and the recipient-specific data 582 are collectively and generally referred to herein as "hearing outcome data" 584, which is provided to the network connected device assessment engine 162.

Using at least the hearing outcome data 584, the network connected device assessment engine 162 is configured to analyze the recipient's hearing outcome in the present acoustic environment. For example, the sound data 580 generally corresponds to the sound signals, or a processed version thereof, captured from the ambient acoustic environment and represents one or more attributes of the captured sound signals. The sound data 580 may indicate, for example, the presence of noise in the ambient acoustic environment, attributes of noise or others sounds in environment, presence of music, presence of reverberation, directivity and/or spatial distribution of sound, short term and/or long term temporal characteristics of sound (e.g., rhythmicity, tonality, amplitude-modulation and frequency modulation components, etc.) etc. As such, the sound data 580 may be used to analyze the recipient's hearing outcome by identifying sound attributes present within the ambient acoustic environment that could affect the recipient's ability to correctly perceive sounds while the recipient is present in the ambient acoustic environment.

The recipient-specific data 582 is data measured from the recipient and, in general, represents the recipient's response to delivered stimulation signals. For example, electrode voltage measurements, electrophysiological measurements (e.g., electrocochleography (ECoG) measurements, electrically evoked compound action potential (ECAP) measurements, higher evoked potential measurements from the brainstem and auditory cortex, measurements relating to neural and mechanoreceptors, these being the hair cells in the cochlea and vestibular system), biological measurements (e.g., biosensors, heart rate, blood pressure), cognitive load, etc.

The recipient-specific data 582 may be used to analyze recipient's hearing outcome in several manners. In certain examples, the recipient-specific data 582 may be used to assess the recipient's auditory perception of the captured sound signals, following delivery of the stimulation signals to the recipient (i.e., analyze the effectiveness or how the recipient is responding to the stimulation by determining whether the recipient correctly perceived the rendered audio). In other examples, the auditory perception may be assessed through interactive techniques subjectively gauge the recipient's feedback to different rendered audio.

In further examples, the recipient-specific data 582 may be used to assess a listening effort of the recipient upon delivery of the stimulation signals to the recipient (i.e., analyze the cognitive load or effort of the recipient to perceive the stimulation signals). This assessment may make use of, for example, EEGs/brain-activity, eye-movements, blood pressure, and infer the cognitive load from these measures and trends. In other examples, the listening effort of the recipient may be assessed through interactive techniques that subjectively gauge the recipient's feedback under varying conditions, and estimate the cognitive load from the success rate of the responses.

As noted, using at least the hearing outcome data 584, the network connected device assessment engine 162 is configured to analyze the recipient's hearing outcome in the present acoustic environment. For example, the network connected device assessment engine 162 evaluates the recipient's hearing outcome, in view of known operational capabilities and the real-time operations of the controllable network connected devices (i.e., the controllable device operation data 586) associated with the ambient acoustic environment, to identify operational changes that could be made to any of the controllable network connected devices to improve the recipient's hearing outcome. The network connected device assessment engine 162 is then configured to generate and send control instructions 585 to selected controllable network connected devices to initiate the determined changes that would improve the recipient's hearing outcome.

Figure 6:
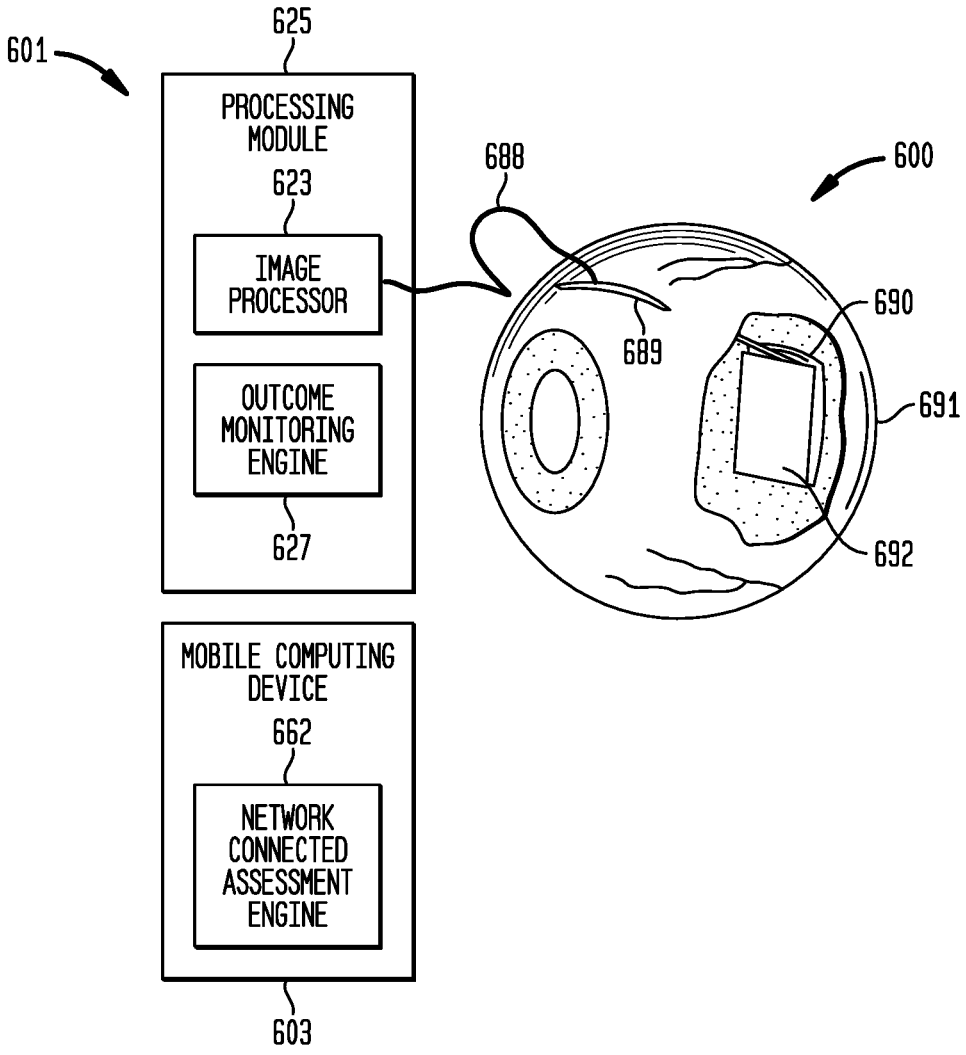
FIG. 6 is a schematic diagram illustrating a retinal prosthesis system comprising a retinal prosthesis and mobile computing device, in accordance with certain embodiments presented herein.

As noted, the operational changes that could be made to any of the controllable network connected devices to improve the recipient's hearing outcome are determined at least based on the hearing outcome data 584 and the controllable device operation data 586 for the controllable network connected devices associated with the ambient acoustic environment. In certain embodiments, these operational changes may also be based on secondary sensor data 586. The secondary sensor data 586 may include, for example, position, orientation, or other spatial information about the auditory prosthesis or controllable network connected devices. The second sensory data 586 could also include an indication of the ambient room/environment conditions. Examples of such indications could include: an indication that the room is getting cold resulting in the recipient shivering and losing concentration (e.g., the room temperature is posing an indirect distraction to the recipient), an indication that the room is getting hot (e.g., the skin temperature of the user is rising, sweat starts to form on the skin, etc.), an indication that the oxygen in the room is reduced (e.g., too many people sitting in the room for too long), The techniques presented herein have generally been described above with reference to an example auditory prosthesis system, namely a cochlear implant system. However, as noted above, the techniques presented herein may also be implemented in other types of sensory prosthesis systems. FIG. 6 is a schematic diagram illustrating an alternative sensory prosthesis system, namely a retinal prosthesis system 601, configured to implement the techniques presented herein.

As shown, the retinal prosthesis system 601 comprises a retinal prosthesis 600 and a mobile computing device 603. The retinal prosthesis 600 comprises a processing module 625 and a retinal prosthesis sensor-stimulator 690 is positioned proximate the retina 691 of a recipient. In an exemplary embodiment, sensory inputs (e.g., photons entering the eye) are absorbed by a microelectronic array of the sensor-stimulator 690 that is hybridized to a glass piece 692 including, for example, an embedded array of microwires. The glass can have a curved surface that conforms to the inner radius of the retina. The sensor-stimulator 690 can include a microelectronic imaging device that can be made of thin silicon containing integrated circuitry that convert the incident photons to an electronic charge.

The processing module 625 includes an image processor 623 that is in signal communication with the sensor-stimulator 690 via, for example, a lead 688 which extends through surgical incision 689 formed in the eye wall. In other embodiments, processing module 625 may be in wireless communication with the sensor-stimulator 690. The image processor 623 processes the input into the sensor-stimulator 690, and provides control signals back to the sensor-stimulator 690 so the device can provide an output to the optic nerve. That said, in an alternate embodiment, the processing is executed by a component proximate to, or integrated with, the sensor-stimulator 690. The electric charge resulting from the conversion of the incident photons is converted to a proportional amount of electronic current which is input to a nearby retinal cell layer. The cells fire and a signal is sent to the optic nerve, thus inducing a sight perception.

The processing module 625 may be implanted in the recipient or may be part of an external device, such as a Behind-The-Ear (BTE) unit, a pair of eyeglasses, etc. The retinal prosthesis 600 can also include an external light/image capture device (e.g., located in/on a BTE device or a pair of glasses, etc.), while, as noted above, in some embodiments, the sensor-stimulator 690 captures light/images, which sensor-stimulator is implanted in the recipient.

In the interests of compact disclosure, any disclosure herein of a microphone or sound capture device corresponds to an analogous disclosure of a light/image capture device, such as a charge-coupled device. Corollary to this is that any disclosure herein of a stimulator unit which generates electrical stimulation signals or otherwise imparts energy to tissue to evoke a hearing percept corresponds to an analogous disclosure of a stimulator device for a retinal prosthesis. Any disclosure herein of a sound processor or processing of captured sounds or the like corresponds to an analogous disclosure of a light processor/image processor that has analogous functionality for a retinal prosthesis, and the processing of captured images in an analogous manner. Indeed, any disclosure herein of a device for a hearing prosthesis corresponds to a disclosure of a device for a retinal prosthesis having analogous functionality for a retinal prosthesis. Any disclosure herein of fitting a hearing prosthesis corresponds to a disclosure of fitting a retinal prosthesis using analogous actions. Any disclosure herein of a method of using or operating or otherwise working with a hearing prosthesis herein corresponds to a disclosure of using or operating or otherwise working with a retinal prosthesis in an analogous manner.

Similar to the above embodiments, the retinal prosthesis system 601 may be used in spatial regions that have at least one controllable network connected device associated therewith (e.g., located therein). As such, the processing module 625 includes a performance monitoring engine 627 that is configured to obtain data relating to a "sensory outcome" or "sensory performance" of the recipient of the retinal prosthesis 600 in the spatial region. As used herein, a "sensory outcome" or "sensory performance" of the recipient of a sensory prosthesis, such as retinal prosthesis 600, is an estimate or measure of how effectively stimulation signals delivered to the recipient represent sensor input captured from the ambient environment.

Data representing the performance of the retinal prosthesis 600 in the spatial region is provided to the mobile computing device 603 and analyzed by a network connected device assessment engine 662 in view of the operational capabilities of the at least one controllable network connected device associated with the spatial region. For example, the network connected device assessment engine 662 may determine one or more effects of the controllable network connected device on the sensory outcome of the recipient within the spatial region. The network connected device assessment engine 662 is configured to determine one or more operational changes to the at least one controllable network connected device that are estimated to improve the sensory outcome of the recipient within the spatial region and, accordingly, initiate the one or more operational changes to the at least one controllable network connected device.

As detailed above, presented herein are techniques to improve a recipient's experience with sensory prostheses, such as auditory prostheses, visual prostheses, etc., in modern environments that are increasingly associated with (e.g., included) controllable network connected devices, such as controllable network connected devices (e.g., IoT devices). Measures made on the sensory inputs (e.g., sound signals) and/or the recipient's response to the sensory inputs (e.g., auditory perception or listening effort) are used in order to adapt controllable network connected devices in the environment to, for example, operate differently or change operational mode if there is a need to do so in the presence of the recipient, so as to improve the recipient's sensory perception. That is, the techniques presented herein dynamically adapt the devices that form or otherwise affect the ambient environment of the recipient in a manner that is estimated to improve the recipient's sensory perception (sensory outcomes).

It is to be appreciated that the embodiments presented herein are not mutually exclusive.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A method, comprising:

monitoring an outcome of a recipient of a hearing device in an ambient environment, wherein the monitored outcome is a sensory perception of the recipient following delivery of stimulation signals to the recipient, and wherein the ambient environment has at least one controllable network connected device associated therewith;

obtaining outcome data representing the monitored outcome;

obtaining controllable device operation data representing operations of the at least one controllable network connected device;

analyzing the outcome data and the controllable device operation data to determine one or more operational changes to the at least one controllable network connected device that are estimated to improve the recipient's outcome in the ambient environment; and initiating the one or more operational changes to the at least one controllable network connected device.

2. The method of claim 1, wherein the controllable device operation data represents known operational capabilities and real-time operations of the at least one controllable network connected device, and wherein analyzing the outcome data ambient environment and the controllable device operation data determine one or more changes to the at least one controllable network connected device that are estimated to improve the recipient's outcome in the ambient environment comprises:

evaluating the outcome data based on known operational capabilities and real-time operations of the at least one controllable network connected device to identify the one or more operational changes to the at least one controllable network connected device.

3. The method of claim 1, wherein analyzing the outcome data and the controllable device operation data to determine one or more operational changes to the at least one controllable network connected device that are estimated to improve the recipient's outcome in the ambient environment includes:

determining an effect of the at least one controllable network connected device on the outcome of the recipient within the ambient environment.

4. The method of claim 1, wherein the sensory perception is an auditory perception.

5. The method of claim 1, wherein the outcome data represents a listening effort of the recipient upon delivery of the stimulation signals to the recipient.

6. The method of claim 1, wherein the outcome data represents one or more attributes of sound signals received at the hearing device.

7. The method of claim 1, wherein initiating the one or more operational changes to the at least one controllable network connected device comprises:

initiate one or more changes to the at least one controllable network connected device to dynamically adapt noise produced in the ambient environment by the at least one controllable network connected device.

8. A method, comprising:

obtaining outcome data representing an outcome of a recipient of a sensory prosthesis within an ambient environment, wherein the outcome is a sensory perception of the recipient following delivery of stimulation signals to the recipient, and wherein the ambient environment includes at least one controllable network connected device that generates noise within the ambient environment when operating;

obtaining controllable device operation data representing operations of the at least one controllable network connected device;

based on the outcome data and the controllable device operation data, determining one or more operational changes to the at least one controllable network connected device to change a characteristic of the noise produced in the ambient environment by the network connected device; and initiating the one or more operational changes to the controllable network connected device.

9. The method of claim 8, wherein determining one or more operational changes to the at least one controllable network connected device comprises:

analyzing the outcome of the recipient within the ambient environment.

10. The method of claim 9, wherein analyzing the outcome of the recipient within the ambient environment comprises:

determining an effect of the at least one controllable network connected device on the outcome of the recipient within the ambient environment.

11. The method of claim 8, wherein: the sensory perception is an auditory perception.

12. The method of claim 9, wherein analyzing the outcome of the recipient within the ambient environment comprises:

assessing a listening effort of the recipient upon delivery of the stimulation signals to the recipient.

13. The method of claim 9, wherein analyzing the outcome of the recipient within the ambient environment comprises:

analyzing one or more attributes of sound signals prior to delivery of the stimulation signals to the recipient.

14. The method of claim 8, further comprising:

determining one or more operational changes to the sensory prosthesis that are estimated to improve the outcome of the recipient within the ambient environment; and initiating the one or more operational changes to the sensory prosthesis.

15. The method of claim 8, wherein the controllable device operation data represents known operational capabilities and real-time operations of the at least one controllable network connected device.

16. An apparatus, comprising:

a wireless transceiver; and one or more processors coupled to the wireless transceiver and configured to:

perform an analysis of an outcome of a recipient of a sensory prosthesis in an ambient environment that has at least one controllable network connected device associated therewith that generates noise within the ambient environment when operating, wherein the outcome is a sensory perception of the recipient following delivery of stimulation signals to the recipient, obtain operational characteristics of the controllable network connected device that pertain to creation of the noise within the ambient environment, and based on the analysis of the outcome in view of the controllable device operation characteristics, initiate one or more changes to the at least one controllable network connected device to change one or more characteristic of the noise produced in the ambient environment by the controllable network connected device.

17. The apparatus of claim 16, wherein the wireless transceiver is configured to:

receive, from the sensory prosthesis, outcome data representing the outcome of a recipient of the sensory prosthesis within the ambient environment; and receive controllable device operation data representing operations of the at least one controllable network connected device, wherein to perform the analysis of the outcome of the recipient of the sensory prosthesis in the ambient environment, the one or more processors are configured to:

determine one or more changes to the at least one controllable network connected device based on the outcome data and the controllable device operation data.

18. The apparatus of claim 16, wherein to perform the analysis of the outcome of the recipient of the sensory prosthesis within the ambient environment, the one or more processors are configured to:

determine an effect of the at least one controllable network connected device on the outcome of the recipient within the ambient environment.

19. The apparatus of claim 16, wherein the sensory perception is an auditory perception.

20. The apparatus of claim 16, wherein to perform the analysis of the outcome of the recipient of the sensory prosthesis within the ambient environment, the one or more processors are configured to:

assess a listening effort of the recipient upon delivery of the stimulation signals to the recipient.

* * * * *